US009938696B2

(12) United States Patent
Quarfordt et al.

(10) Patent No.: US 9,938,696 B2
(45) Date of Patent: Apr. 10, 2018

(54) LOCK FOR TOOL HOLDER

(71) Applicant: Combi Wear Parts AB, Kristinehamn (SE)

(72) Inventors: Per Quarfordt, Storfors (SE); Adnan Gabela, Kristinehamn (SE)

(73) Assignee: COMBI WEAR PARTS AB, Kristinehamn (SE)

( * ) Notice: Subject to any disclaimer, the term of this patent is extended or adjusted under 35 U.S.C. 154(b) by 0 days.

(21) Appl. No.: 14/429,800

(22) PCT Filed: Sep. 12, 2013

(86) PCT No.: PCT/SE2013/000140
§ 371 (c)(1),
(2) Date: Mar. 20, 2015

(87) PCT Pub. No.: WO2014/046587
PCT Pub. Date: Mar. 27, 2014

(65) Prior Publication Data

US 2015/0218782 A1 Aug. 6, 2015

(30) Foreign Application Priority Data

Sep. 21, 2012 (SE) ..... 1230098

(51) Int. Cl.
*E02F 9/28* (2006.01)

(52) U.S. Cl.
CPC ..... *E02F 9/2833* (2013.01); *E02F 9/2825* (2013.01); *E02F 9/2841* (2013.01)

(58) Field of Classification Search
CPC ..... E02F 9/2808–9/2891; Y10T 403/7069
See application file for complete search history.

(56) References Cited

U.S. PATENT DOCUMENTS 2,435,847 A 2/1948 Robertson
5,638,621 A 6/1997 Keech et al.
(Continued)

FOREIGN PATENT DOCUMENTS

CA 2316712 A1 2/2001
EP 2672026 A2 12/2013
(Continued)

OTHER PUBLICATIONS

Translation of Japanese Office Action dated Mar. 10, 2017 in JP Application No. 2015-533010.

*Primary Examiner* — Robert E Pezzuto
*Assistant Examiner* — Adam J Behrens
(74) *Attorney, Agent, or Firm* — Polsinelli PC

(57) ABSTRACT

The invention relates to a lock for releasable locking of an excavating tooth to a wearing-part holder in a wearing-part system, where the excavating tooth and the wearing-part holder together define a lock opening for receiving the lock, where the lock comprises a threaded conical screw and a first thread half designed with a first thread bed, where the first thread half and a second thread half, designed with a second thread bed, are mounted in the lock opening, where the first thread half and the second thread half, with the thread beds directed towards each other, together define an opening for threaded fastening of the threaded conical screw, such that rotation of the threaded screw moves the threaded screw along the thread beds in the axial direction of the screw into the lock opening, locking the lock when the first thread half is moved towards the excavating tooth and the second thread half is moved towards the wearing-part holder. The invention also relates to a wearing-part system, a first thread half, a second thread half, a conical screw, and an associated method for releasable locking of an excavating tooth to a wearing-part holder in a wearing-part system with lock.

4 Claims, 7 Drawing Sheets

(56) References Cited

U.S. PATENT DOCUMENTS

Figure 1:
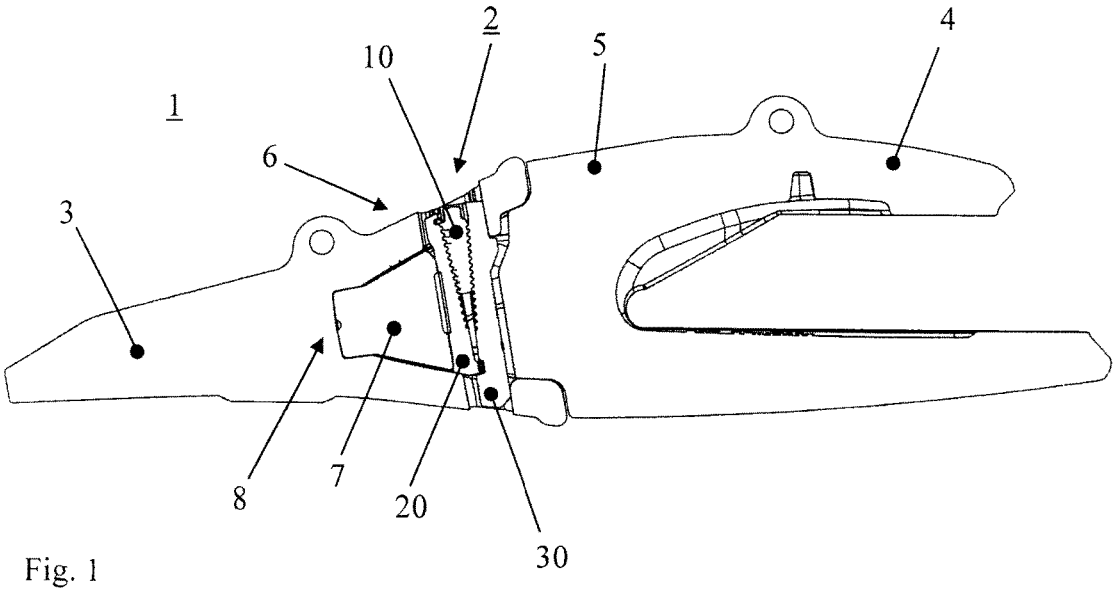

| | | | | |
|---|---|---|---|---|
| 5,937,550 | A * | 8/1999 | Emrich | E02F 9/2841 37/456 |
| 6,986,216 | B2 | 1/2006 | Emrich et al. | |
| 7,174,661 | B2 * | 2/2007 | Briscoe | E02F 9/2833 37/455 |
| 7,299,570 | B2 * | 11/2007 | Emrich | E02F 9/2833 37/451 |
| 7,526,886 | B2 * | 5/2009 | McClanahan | E02F 9/2841 37/450 |
| 7,762,751 | B2 * | 7/2010 | Panasik | F16B 13/002 411/30 |
| 7,832,129 | B2 * | 11/2010 | Briscoe | E02F 9/2841 37/455 |
| 7,997,017 | B2 * | 8/2011 | McClanahan | E02F 9/2833 37/455 |
| 8,104,200 | B2 * | 1/2012 | Briscoe | E02F 9/2841 37/455 |
| 8,720,087 | B2 * | 5/2014 | Briscoe | E02F 9/2841 37/456 |
| 8,898,937 | B2 * | 12/2014 | Campomanes | E02F 9/2825 37/456 |
| 8,978,277 | B2 * | 3/2015 | Knight | E02F 9/2833 37/456 |
| 9,512,600 | B2 * | 12/2016 | Briscoe | E02F 9/2841 |
| 2004/0216334 | A1 * | 11/2004 | Emrich | E02F 9/2833 37/452 |
| 2004/0216336 | A1 * | 11/2004 | Briscoe | E02F 9/2833 37/455 |
| 2006/0010726 | A1 * | 1/2006 | Emrich | E02F 9/2833 37/456 |
| 2006/0059732 | A1 * | 3/2006 | Clendenning | E02F 9/2833 37/456 |
| 2006/0078373 | A1 * | 4/2006 | Dingwall | E02F 9/2825 403/315 |
| 2007/0051022 | A1 * | 3/2007 | Meyers | E02F 9/2825 37/455 |
| 2007/0137071 | A1 * | 6/2007 | McClanahan | E02F 9/2833 37/452 |
| 2007/0137072 | A1 * | 6/2007 | Briscoe | E02F 9/2841 37/453 |
| 2007/0193075 | A1 * | 8/2007 | Carpenter | E02F 9/28 37/452 |
| 2007/0293074 | A1 * | 12/2007 | McClanahan | E02F 9/2833 439/206 |
| 2008/0092413 | A1 * | 4/2008 | McClanahan | E02F 9/2883 37/451 |
| 2010/0050402 | A1 | 3/2010 | Rissman | |
| 2010/0229433 | A1 * | 9/2010 | Leslie | E02F 9/2841 37/456 |
| 2011/0072693 | A1 * | 3/2011 | Knight | E02F 9/2833 37/456 |
| 2011/0252672 | A1 * | 10/2011 | Briscoe | E02F 9/2841 37/456 |
| 2013/0247429 | A1 * | 9/2013 | Campomanes | E02F 9/2825 37/456 |

FOREIGN PATENT DOCUMENTS

| | | | |
|---|---|---|---|
| JP | 4290/74 | | 1/1974 |
| JP | 54020501 | U | 2/1979 |
| JP | 1087906 | | 4/1989 |
| JP | 2008-517710 | A | 5/2008 |
| JP | 2009-243488 | A | 10/2009 |
| WO | WO-2006/049708 | A1 | 5/2006 |
| WO | WO-2011/069183 | A1 | 6/2011 |
| WO | WO-2011/133411 | A1 | 10/2011 |
| WO | WO-2013/142132 | A1 | 9/2013 |

* cited by examiner

LOCK FOR TOOL HOLDER

CROSS REFERENCE TO RELATED APPLICATIONS

This application is a National Phase filing under 35 U.S.C. § 371 of PCT/SE2013/000140 filed on Sep. 12, 2013; and this application claims priority to Application No. 1230098-4 filed in Sweden on Sep. 21, 2012 under 35 U.S.C. § 119. The entire contents of each application are hereby incorporated by reference.

The present invention relates to a lock for releasable locking of an excavating tooth to a wearing-part holder in a wearing-part system, where the excavating tooth and the wearing-part holder together define a lock opening for receiving the lock, where the lock comprises a threaded conical screw and a first thread half designed with a first thread bed. The invention also relates to a wearing-part system, a first thread half, a second thread half, a conical screw, and an associated method for releasable locking of an excavating tooth to a wearing-part holder in a wearing-part system with lock.

Various types of plant machinery, such as excavating machines, wheel-mounted loaders, excavating loaders or other types of machines intended to excavate or otherwise work or move material or sediment, usually use excavating teeth or another replaceable wearing part or tool mounted on the bucket or the apparatus that is used to work or move the material. For plant machinery designed to work the material or sediment using excavating teeth, wear in most cases occurs on the excavating teeth with which the plant machinery is equipped. The excavating tooth is designed to be able to be replaced after it has become worn, and the excavating teeth are designed to work in different ways the material or sediment that is to be worked by the plant machinery. The excavating tooth is mounted on the bucket, for example by a screw connection or a cottered joint. Various types of thermal assembly, such as welding or shrink-fitting, are other conceivable assembly methods.

The excavating tooth can be mounted in a wearing-part holder or tool holder and replaced on a continuous basis. Forces acting on the tool affect the wearing-part holder and, after a considerable period of use, the wearing-part holder may also need to be changed. Traditionally, the wearing-part holder is welded to the bucket or apparatus or is mounted thereon using another thermal joining technique. However, it is also conceivable that the wearing-part holder is mounted using a screw connection, cottered joint or other mechanical method of assembly. It may also be that the excavating tooth is mounted directly on the bucket or the apparatus.

Patent document U.S. Pat. No. 7,997,017 describes a tool device or wearing-part device with a clamp or a wedge for securing a wearing part to a holder. The wedge is shaped as a conical screw with a thread on its surface. The clamp is designed with at least one upper arm, preferably two arms creating a T-shape of the clamp. The clamp also has a lower arm. The clamp is designed with a ramp that faces the surface of the wedge. The ramp is concave and designed with depressions creating a thread formation matching the thread formation on the wedge. The clamp is designed with a cavity filled with an elastomer. Upon assembly of a wearing part, the clamp is first mounted such that the T-shape fits into a recess formed in the wearing part and the lower arm fits into a recess formed in the holder. Thereafter, the wedge is screwed between basically the holder and the clamp. In the invention described in patent document U.S. Pat. No. 7,997,017, the thread contact between the wedge and the clamp is thus limited to a single clamp's thread surface which, especially in the initial stage of assembly, provides a limited mechanical contact between the wedge and the clamp. The bearing of the wedge against the holder also means that the thread on the wedge bears on an unthreaded surface during assembly, for which reason the thread is designed specially for the purpose with a large bearing surface and not as a conventional thread with a pointed design.

An example of a patent document that describes a tool device or wearing-part device is U.S. Pat. No. 6,986,216 B1. The patent document describes a solution for assembly of an adapter on an excavating machine or earth mover. The wearing part is then mounted on the adapter. The device is intended to be able to be used to replace the existing solution for locking the adapter as is described in the patent document. Two bosses are mounted in the lip, preferably by welding in a notch formed in the two bosses. A keyway insert can be mounted on the lip by welding and can function as a wearing surface against the wedge. The lock consists of a wedge and a clamp which has reciprocal threads. The clamp has a channel designed with a raised edge that faces the groove of the wedge when the wedge is screwed against the clamp. The wedge is designed with a recess in which an elastomer can be mounted. Locking hooks can be formed in the clamp for locking against teeth in the grooves of the wedge. The clamp is provided with a handle to facilitate the mounting of the clamp. In the invention described in patent document U.S. Pat. No. 6,986,216 B1, the wedge is threaded against a reciprocally threaded wedge and a keyway insert. Since the keyway insert lacks a thread, the bearing of the wedge against the keyway insert means that the thread on the wedge bears on an unthreaded surface during assembly, for which reason the threading is designed especially for the purpose with a large bearing surface and not as a customary thread with a pointed design.

Patent document US2007/0051022 discloses a tooth for an excavating machine or earth mover comprising a lock consisting of two parts running against each other in the form of clamps, and a screw which, during screwing, moves the two clamps relative to each other in the axial direction of the screw.

An object of the present invention is to propose a lock for a wearing-part system for simple and improved assembly of a wearing part to a holder.

Other objects of the invention are described in more detail in connection with the detailed description of the invention.

The invention relates to a lock for releasable locking of an excavating tooth to a wearing-part holder in a wearing-part system, where the excavating tooth and the wearing-part holder together define a lock opening for receiving the lock, where the lock comprises a threaded conical screw and a first thread half designed with a first thread bed, where the first thread half and a second thread half, designed with a second thread bed, are mounted in the lock opening, where the first thread half and the second thread half, with the thread beds directed towards each other, together define an opening for threaded fastening of the threaded conical screw, such that rotation of the threaded screw moves the threaded screw along the thread beds in the axial direction of the screw into the lock opening, locking the lock when the first thread half is moved towards the excavating tooth and the second thread half is moved towards the wearing-part holder.

According to further aspects of the improved lock for releasable locking of an excavating tooth to a wearing-part holder in a wearing part system, provision is made as follows:

that a protective cap, designed with an assembly hole, is placed on the screw head of the conical screw and retains the conical screw in the screwed-in position by virtue of the fact that wings lock the protective cap and thus the screw between the first thread half and the second thread half;

that the wearing-part holder, in the lock opening, is designed with a cavity for receiving an upper rear arm formed on the second thread half, and a cavity for receiving an upper lateral arm formed on the first thread half, and an upper lateral arm formed on the second thread half when the first thread half and the second thread half are placed in the lock opening; the cavities formed to hold the upper lateral arms of the thread halves retain the thread halves in the assembly opening;

that the excavating tooth, in the lock opening, is designed with a lower pin against which a lower recess formed on the first thread half is placed, and an upper pin against which an upper rear arm formed on the second thread half is placed.

The invention also relates to a wearing-part system comprising a wearing-part holder, an excavating tooth, a lock arrangement, where the lock arrangement comprises a first thread half designed with a first thread bed and a conical screw for locking the excavating tooth to the wearing-part holder, where the lock arrangement comprises the first thread half, the conical screw and a second thread half designed with a second thread bed, wherein the first thread half is mounted in a lock opening with the first thread bed directed towards the wearing-part holder, and the second thread half is mounted in the lock opening with the second thread bed directed towards the excavating tooth, wherein the thread beds together define an opening in which the conical screw can rotate and move along the thread beds in the axial direction of the screw, such that the first thread half is moved towards the excavating tooth and the second thread half is moved towards the wearing-part holder, locking the excavating tooth to the wearing-part holder.

The invention also relates to a first thread half, where the first thread half is a part of a lock, where the first thread half is designed with a first thread bed, an upper lateral arm formed at right angles out from the centre line of the first thread half and at right angles from the first cross section passing through the front face and rear face of the first thread half, in the upper part of the first thread half, and a lower heel formed at right angles from the centre line of the first thread half out from the front face in the lower part of the first thread half, and a lower recess formed at right angles from the centre line of the first thread half in from the rear face in the lower part of the first thread half.

According to further aspects of the first thread half, provision is made as follows:

that the thread bed of the first thread half is designed as a trapezoidal thread, and where the first thread bed is designed with a pitch corresponding to 6-10 mm per turn, and that the first thread half is produced entirely by forging.

The invention also relates to a second thread half, where the second thread half is a part of a lock, where the second thread half is designed with a second thread bed, an upper lateral arm formed at right angles out from the centre line of the second thread half and at right angles from the second cross section passing through the front face and rear face of the second thread half, in the upper part of the second thread half, and an upper rear arm formed at right angles from the centre line of the second thread half in a direction out from the rear face on the second thread half.

According to further aspects of the second thread half, provision is made as follows:

that the thread bed of the second thread half is designed as a trapezoidal thread, and where the second thread bed is designed with a pitch corresponding to 6-10 mm per turn, and that the second thread half is produced entirely by forging.

The invention also relates to a conical screw, where the conical screw is a part of a lock, where the thread of the conical screw is a trapezoidal thread designed with thread portions with varied pitch.

According to further aspects of the conical screw, provision is made as follows:

that the thread of the conical screw is designed with a pitch corresponding to 6-10 mm per turn;

that the conical screw is produced entirely by forging; the fact that production takes place by forging is important for achieving a high degree of strength, for keeping the production costs low, and for obtaining a suitable surface that contributes to the conical screw having suitable friction against the two thread halves and to thus maintaining the conical screw in the screwed-in position between the thread halves.

The invention also relates to a method for releasable locking of an excavating tooth to a wearing-part holder in a wearing-part system with a lock comprising a threaded conical screw and a first thread half with a thread bed, where:

a) the excavating tooth is mounted against the wearing-part holder;

b) the first thread half, designed with the first thread bed, and a second thread half, designed with a second thread bed, are mounted facing each other in an assembly opening formed in the excavating tooth together with the wearing-part holder;

c) the threaded conical screw is mounted in an opening between the first thread half and the second thread half;

d) the lock is expanded and locks the wearing part to the holder when, during the screwing-in of the threaded conical screw, the axial movement of the threaded conical screw moves the first thread half and the second thread half at right angles out from the axial direction of the conical screw; and e) the lock is contracted and releases the wearing part from the holder when, during the unscrewing of the threaded conical screw, the axial movement of the threaded conical screw moves the first thread half and the second thread half at right angles in towards the axial direction of the conical screw.

The invention is described in more detail below with reference to the attached figures, where:

FIG. 1 shows a cross section of a wearing-part system according to one embodiment of the invention.

Figure 2A:
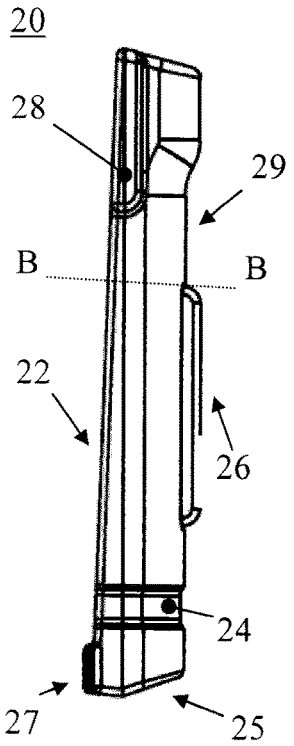

FIG. 2*a* shows the first thread half in a view from the side, according to one embodiment of the invention.

FIG. 2*b*, FIG. 2*c*, FIG. 2*d* and FIG. 2*e* each show another view of the first thread half according to one embodiment of the invention.

Figure 3A:
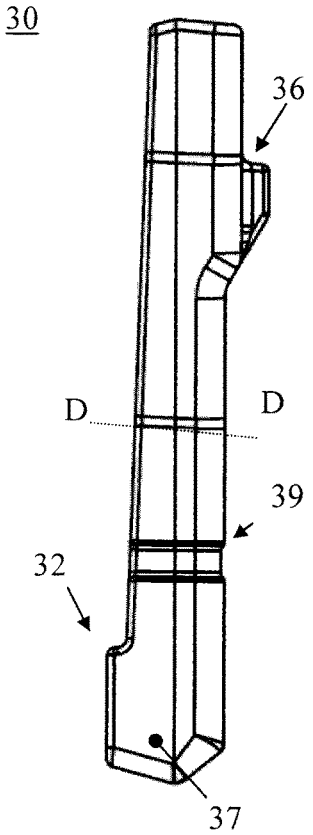

FIG. 3*a* shows the second thread half in a view from the side, according to one embodiment of the invention.

FIG. 3*b*, FIG. 3*c*, FIG. 3*d* and FIG. 3*e* each show another view of the second thread half according to one embodiment of the invention.

Figure 4A:
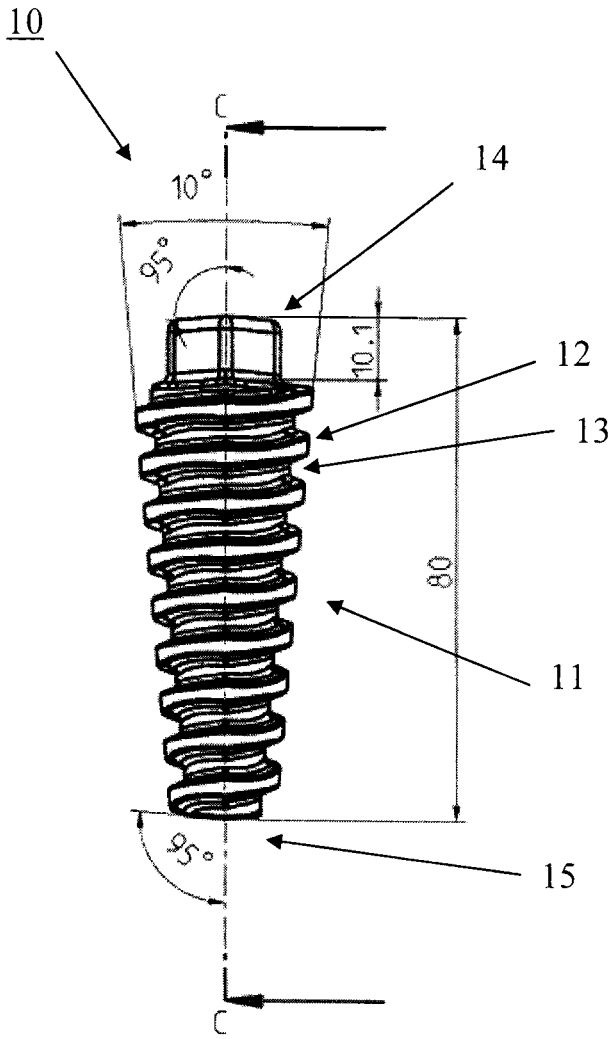

FIG. 4*a* shows the conical screw according to one embodiment of the invention.

Figure 4B:
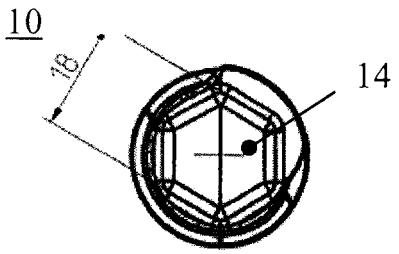

FIG. 4*b* shows the conical screw according to one embodiment of the invention in a view from above.

Figure 5A:
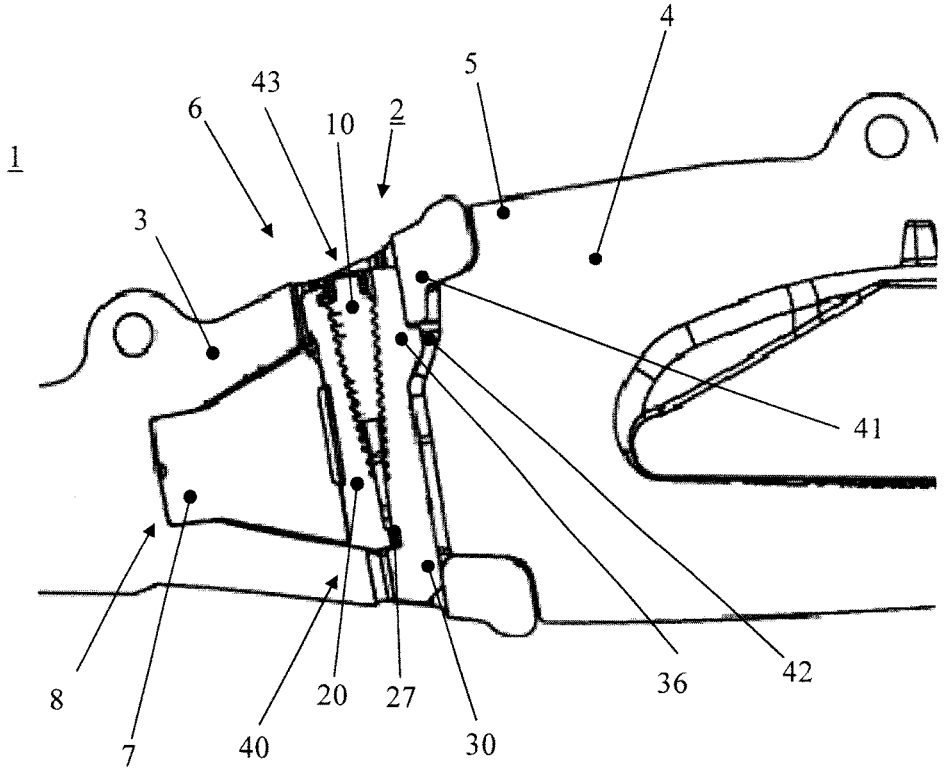

FIG. 5*a* shows a cross-sectional view of an enlarged part of a wearing-part system according to one embodiment of the invention.

Figure 5B:
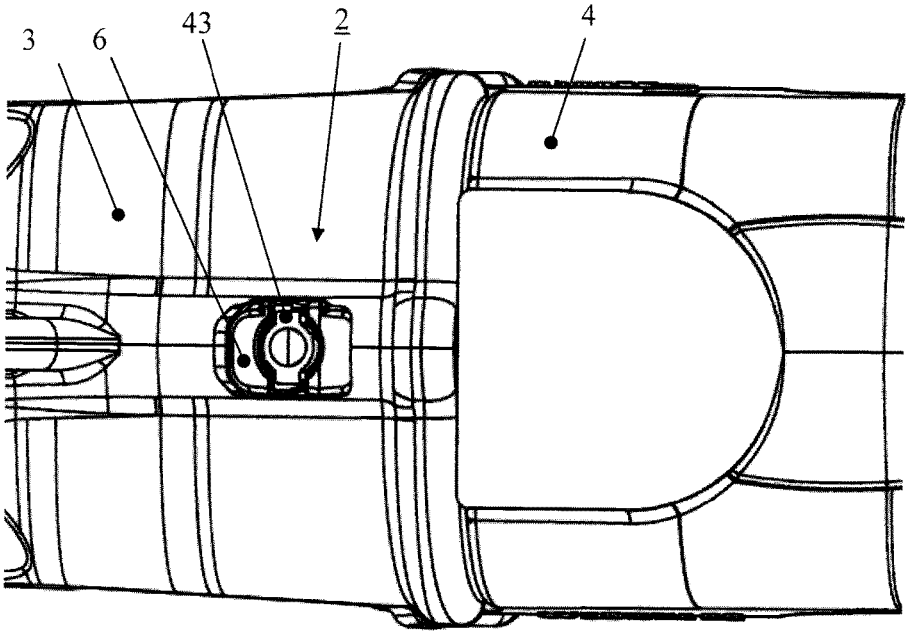

FIG. 5*b* shows part of the wearing-part system according to one embodiment of the invention in a view from above.

Figure 6A:
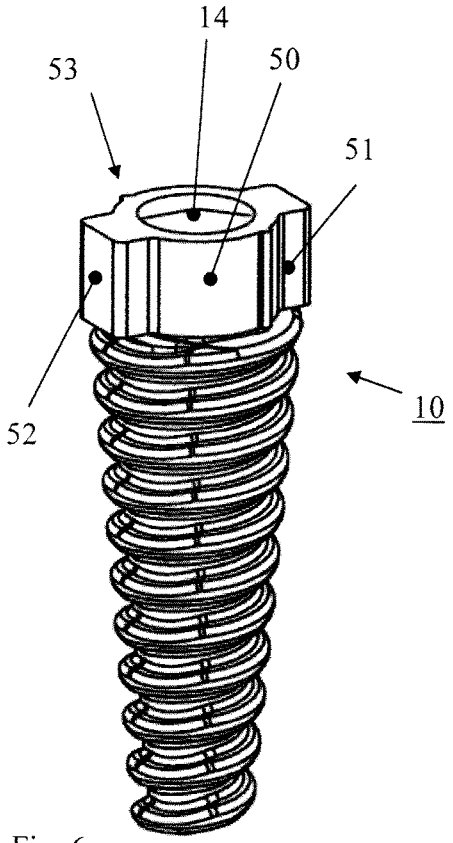

FIG. 6*a* shows a view of the conical screw with a protective cap according to one embodiment of the invention.

Figure 6B:
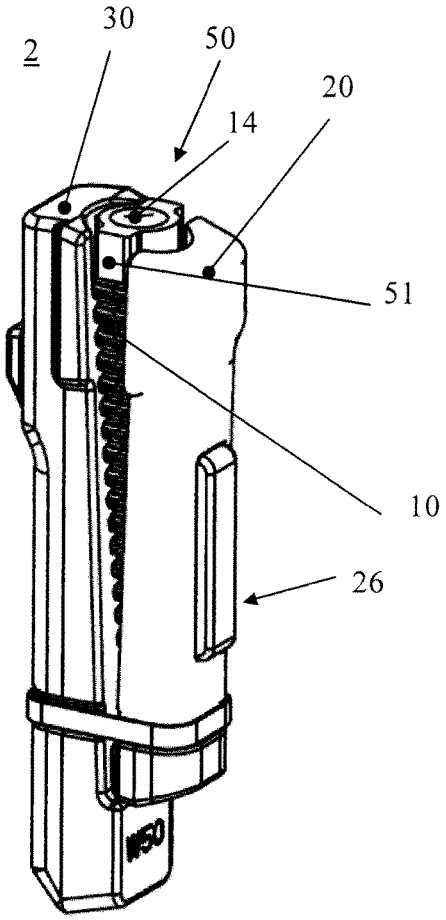

FIG. 6*b* shows a view of the lock with a protective cap mounted according to one embodiment of the invention.

Figure 7:
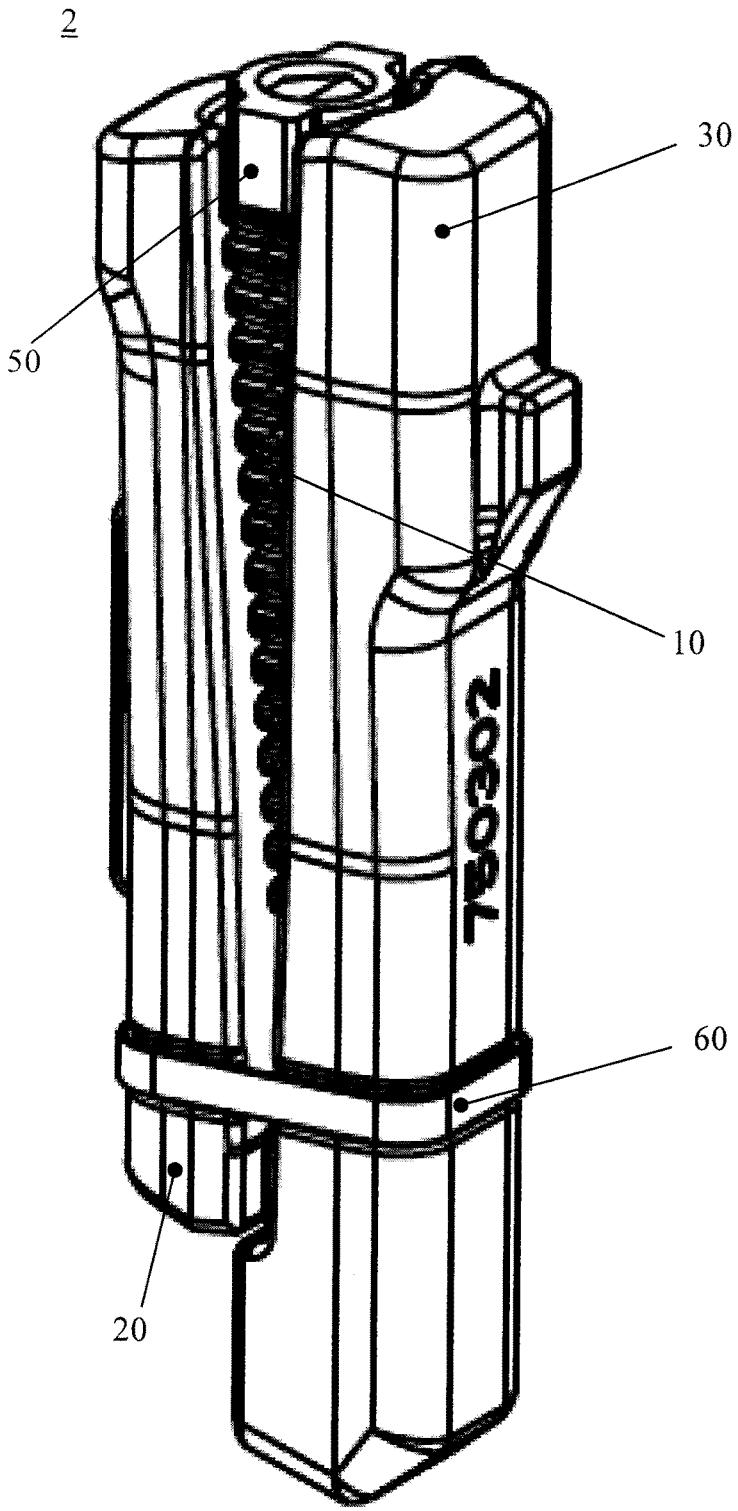

FIG. 7 shows a view of the lock with a protective cap and a retainer device mounted according to one embodiment of the invention.

The cross section in FIG. 1 shows one of the embodiments of a wearing-part system 1. An excavating tooth 3, or another form of tool or wearing part, is mounted on a wearing-part holder 4, also referred to as holder, tool holder or adapter. The excavating tooth 3 can also be mounted directly on the bucket or the apparatus using the excavating tooth. The excavating tooth is mounted with a lock 2 which locks the excavating tooth 3 to the wearing-part holder 4. When the excavating tooth 3 is a wearing part, the excavating tooth will be changed when the degree of wear is such that the excavating tooth 3 needs to be replaced. When the excavating tooth is replaced, it is important that the replacement is easy to do and that locking is such that the excavating tooth is retained on the wearing-part holder. Traditionally, different types of locking methods have been used, for example different types of wedges or welded connections. The assembly methods known in the prior art which efficiently lock the excavating tooth were shown to be less effective during the change of excavating tooth and, conversely, the assembly methods known in the prior art which made the change of excavating tooth easier have shortcomings as regards the locking of the excavating tooth to the wearing-part holder. The lock shown in FIG. 1 consists of a conical screw 10, also called wedge, a first thread half 20, also called first clamp or front thread half, and a second thread half 30, also called second clamp or rear thread half. The conical screw 10, which is designed as a screw with a thread, locks the first thread half 20 and the second thread half 30 between the excavating tooth 3 and the wearing-part holder 4. The lock 2 is placed in a lock opening 6 which arises when the excavating tooth 3 is placed against the wearing-part holder 4. Thus, both the excavating tooth 3 and also the wearing-part holder 4 are designed with openings in order to create the lock opening 6 where the lock 2 is put in place. When the excavating tooth 3 is placed against the wearing-part holder 4, the tip 7 formed on the wearing-part holder 4 fits into a recess 8 formed on the excavating tooth 3, and, when the tip 7 is fully inserted in the recess 8, the lock opening 6 defines an opening where the lock 2 can be placed and can lock the excavating tooth 3 to the wearing-part holder 4. The wearing-part holder 4 is designed with a wear cap 5, which is used to protect the wearing-part holder. The wearing-part holder can also be designed without a wear cap 5.

Figure 2B:
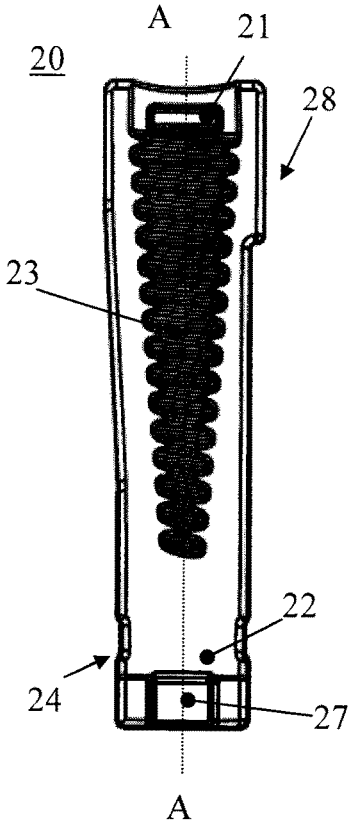
Figure 2C:
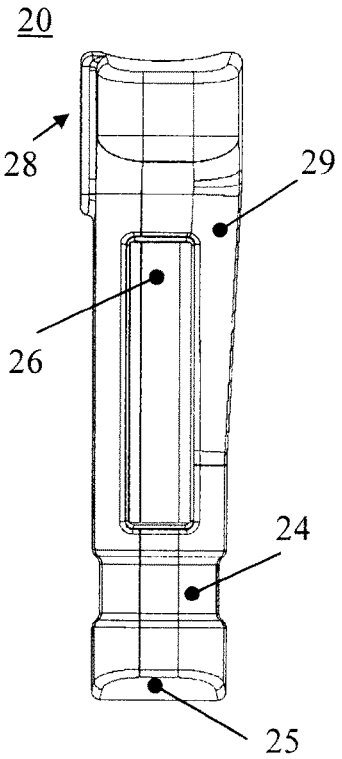
Figure 2D:
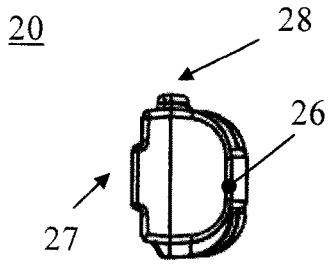
Figure 2E:
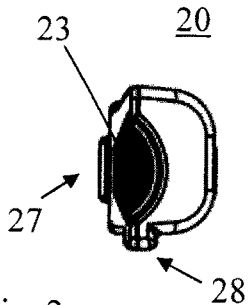

FIG. 2*a* shows a side view of the first thread half 20, which is preferably designed with a lower heel 27 to facilitate the positioning against the second thread half 30, and an upper lateral arm 28 and a lower recess 25 to be able to place the first thread half 20 in the lock opening 6. The lower recess 25 is formed in the rear face 29 of the first thread half. Upon assembly of the first thread half 20, the rear face 29 of the first thread half is placed substantially against the excavating tooth 3. On the rear face 29 of the first thread half 20 there is a flexible ridge 26. The flexible ridge 26 can be made of elastomer, for example. In cases where the lock 2 and therefore the first thread half 20 are designed to be used in hot environments, the flexible ridge 26 is made of a heat-resistant material, for example steel or other metal. Upon assembly, the front face 22 of the first thread half is directed towards the front face 32 of the second thread half 30. Thus, the first thread bed 23 of the first thread half 20 is directed towards the second thread bed 33 of the second thread half 30. FIG. 2*b* shows a view of the first thread half 20, where the first thread bed 23 can be seen. The first thread bed 23 is concave and is designed to face the thread 11 on the conical screw 10. The first thread bed is inclined, or ramp-shaped, with a deeper recess in the upper part of the first thread half 20 and a shallower recess towards the end of the thread in the lower part of the first thread half 20. The first thread half 20 is designed with a retainer device recess 24 in which a retainer device 60 can be placed in order to retain the first thread half 20 against the second thread half 30. The recess 21, which is formed before the thread bed 23 an the upper part of the first thread half 20, forms, together with the recess 31 on the second thread half 30, a cavity in which the screw head 14 of the conical screw 10 and/or the upper part of the conical screw 10 sits when the conical screw 10 has been tightened or threaded in the lock 2. The first thread half 20 is preferably placed with the rear face 29 directed towards the excavating tooth 3, as seen from the lock opening 6. FIG. 2*c* shows a view of the rear face 29 of the first thread half 20, where the upper lateral arm 28 is placed in the upper part of the first thread half. FIG. 2*d* shows a view of the first thread half 20 from below. FIG. 2*e* shows a view of the first thread half 20 from above, where the upper lateral arm 28 is positioned at right angles out from the centre line A of the first thread half 20 and at right angles from the first cross section B, which is in line with the direction through the first thread bed 23 passing through the front face 22 and rear face 29 of the first thread half. The lower heel 27 is positioned at right angles from the centre line A of the first thread half 20 in a direction with the thread bed, out from the front face 22. The first thread bed 23 of the first thread half 20 is preferably a trapezoidal thread and designed such that it can be produced by forging, with the thread top and the thread bottom being chosen with a draft or inclination suitable for forging tools. Since the first thread bed 23 is designed to be able to be forged, the whole of the first thread half 20 can be produced by forging. The groove width at the thread top, in the thread bed of the first thread half, is between 70 percent and 90 percent of the groove width at the thread bottom of the first thread bed, where the first thread bed is designed with a pitch corresponding to 6-10 mm per turn. Both the pitch and also the groove width can be freely varied and adapted to different excavating teeth and tool holders.

Figure 3B:
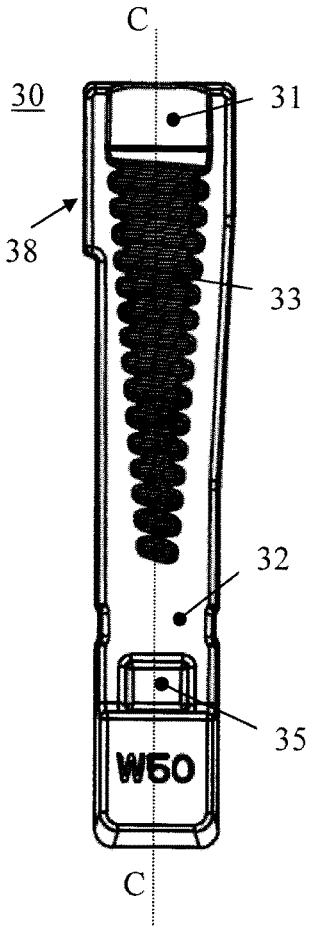
Figure 3C:
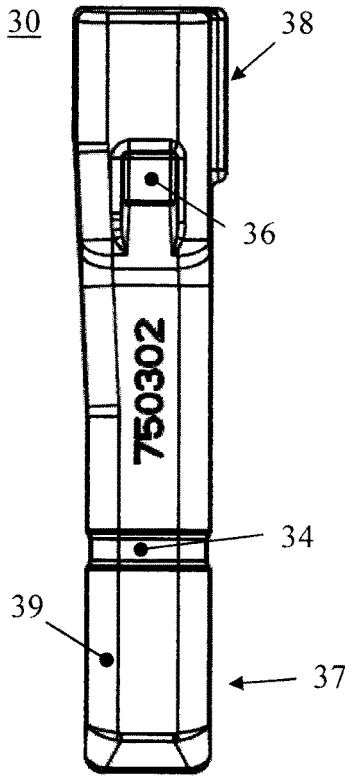
Figure 3D:
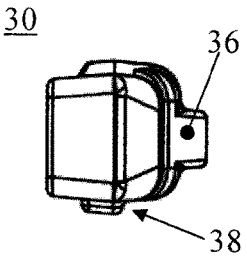
Figure 3E:
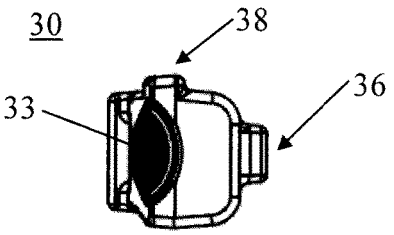

FIG. 3*a* shows the second thread half 30 in a view from the side, where an upper rear arm 36 is designed to fit into a cavity obtained in the excavating tooth 3 when mounted on the wearing-part holder 4. The upper rear arm 36 has a heel formation which matches the excavating tooth 3 when the second thread half 30 is mounted in the lock opening 6. The second thread half 30 is designed with a lower recess 35, which is formed in the front face 32 of the second thread half and in which the heel 27 of the first thread half fits. FIG. 3*b* shows a view of the front face 32 of the second thread half in which the second thread bed 33 can be seen. The second thread bed 33 is concave and designed to face the thread 11 on the conical screw 10. The second thread bed is inclined, or ramp-shaped, with a deeper recess in the upper part of the second thread half 30 and a shallower recess nearer the end of the second thread bed 33 in the lower part of the second thread half 30. The second thread half 30 is preferably placed with the rear face 39 directed towards the wearing-part holder 4, as seen from the lock opening 6. The second thread half 30 is preferably designed with a lower recess 35 in order to facilitate the positioning against the lower heel 27 of the first thread half 20. The lower heel 27 of the first thread half is designed to fit in the recess 35 of the second thread half. FIG. 3*c* shows the rear face 39 of the second thread half 30, with the upper rear arm 36 shown. FIG. 3*d* shows a view of the second thread half 30 from below. FIG. 3*e* shows a view of the second thread half 30 from above, in which the upper lateral arm 38 is positioned at right angles out from the centre line C of the second thread half 30 and at right angles from the second cross section D, which is in line with the direction through the second thread bed 33 and passing through the front face 32 and rear face 39 of the second thread half. Moreover, the upper rear arm 36 is positioned at right angles from the centre line C of the second thread half 30 in a direction out from the rear face 39. The second thread bed 33 in the second thread half 30 is preferably a trapezoidal thread and designed such that it can be produced by forging, with the thread top and the thread bottom being chosen with a draft or inclination suitable for forging tools. Since the second thread bed 33 is designed to be able to be forged, the whole of the second thread half 30 can be produced by forging. The groove width at the thread top, in the thread bed of the second thread half, is between 70 percent and 90 percent of the groove width at the thread bottom of the second thread bed, where the second thread bed is designed with a pitch corresponding to 6-10 mm per turn. Both the pitch and also the groove width can be freely varied and adapted to different excavating teeth and tool holders. The second thread half 30 is designed with a continuation 37 which is advantageous for orientation of the second thread half 30, and therefore of the lock 2, when placing the lock 2 in the assembly opening 6.

FIG. 4*a* shows the conical screw 10. The conical screw 10 is designed with a pitch 11. The pitch 11 is preferably a trapezoidal thread and has a thread top 12 and a thread bottom 13. The conical screw has a screw head 14 and a tip 15. The thread of the conical screw is designed to match the thread beds 23, 33, and, when the conical screw is rotated, preferably clockwise, the conical screw 10 comes to be moved in between the first thread half 20 and the second thread half 30 when the thread halves are mounted in the lock 2. The conical screw is preferably produced by forging, although machining is also possible. The thread bottom 13 of the conical screw preferably has a slightly smaller groove width, or length, in the axial direction of the conical screw 10 than does the thread top 12 of the conical screw. Since the groove width at the thread bottom 13 is smaller than the thread top 12, the thread 11 is designed sloping from the thread bottom 13 to the thread top 12. The thread bottom 13 is of the order of 70 percent to 90 percent of the groove width at the thread top 12. By virtue of an inclined design, or draft, the conical screw can be produced by forging. The design of the conical screw 10 and the method of production by forging mean that the conical screw 10 is self-locking when it is drawn between the first thread half 20 and the second thread half 30. The conical screw 10 is produced by forging. The forging tool forms the conical screw 10 by two tool halves pressing the conical screw 10 in the axial direction of the conical screw. When the forging tool is designed with so-called draft, which means that the screw more easily comes loose from the forging tool, the trapezoidal thread of the conical screw has a design with a variable pitch over the thread 11 of the screw. The appearance of the pitch 11 of the conical screw 10 is that, for each thread turn, there are two portions where the pitch is absent and the thread 11 is straight. Where the thread is straight or almost straight, there is no thread pitch or almost no thread pitch in the axial direction of the conical screw. These straight or flat portions contribute to the conical screw 10 having a locking function when the conical screw is assembled against the first thread half 20 and the second thread half 30. The conical screw 10 is given a thread 11 with a variable pitch over one thread turn, and two portions in each thread turn come to have a straight or flat configuration. There are two thread portions per thread turn where the pitch is considerably less, or completely straight, compared to the pitch on the remaining part of the thread turn. FIG. 4*b* shows the conical screw 10 from the top, where the screw head 14 is of the six-sided type, although it is possible to use other variants such as a hexagon socket or Torx.

FIG. 5*a* shows an enlarged part of a cross section of a wearing-part system 1. The first thread half is mounted against the lower pin 40 formed on the excavating tooth 3 when the lower recess 25 of the first thread half 20 is placed against the lower pin 40 of the excavating tooth. The second thread half is mounted against the upper pin 41 formed on the excavating tooth 3 when the upper rear arm 36 of the second thread half 30 is placed against the upper pin 41 of the excavating tooth 3. The lock opening 6 of the wearing-part holder 4 is designed with a cavity 42 for receiving the upper rear arm 36 of the second thread half 30 when the second thread half is placed in the lock opening 6. FIG. 5*b* shows the wearing-part system 1 in a view seen from above, where the lock opening 6 is visible, as is the cavity 43 in which the upper lateral arm 28 of the first thread half 20 and the upper lateral arm 38 of the second thread half 30 are placed in order to retain the first thread half 20 and the second thread half 30. Thus, the front face 22 of the first thread half 20 and the front face 32 of the second thread half 30 are placed such that they are directed towards each other and such that the upper lateral arms 28, 38 face the cavity 43. The cavity 43 can be formed in the excavating tooth 3 or the wearing-part holder 4, or partially in the excavating tooth 3 and partially in the wearing-part holder 4.

FIG. 6*a* shows the conical screw 10 with a protective cap 50 mounted on the screw head 14. The protective cap 50 is a protective device for the screw head 14 and a locking device for the conical screw 10. The protective cap 50 is made of rubber or another elastomer or of a soft metal such that, on the one hand, it can be mounted elastically on the screw head 14 and, on the other hand, can provide considerable friction against the screw head 14. The protective cap is designed with a hole 53 in which the screw head 14 is pressed. The hole 53 formed in the protective cap 50 can be circular, but it can also have other configurations or shapes for achieving contact with the screw head 14 with high friction between the screw head 14 and the protective cap 50. The protective cap 50 is designed with at least one arm, preferably two arms 51, 52 which, when the protective cap 50 has been placed on the screw head 14, lock the screw head 14 in the assembly hole 53 and lock the protective cap 50 between the first thread half 20 and the second thread half 30. FIG. 6*b* shows a lock 2 with a first thread half 20, a second thread half 30, the conical screw 10 and a protective cap 50. The protective cap 50 locks the conical screw 10 when the protective cap 50 has been placed on the screw head 14 and, by means of a friction coupling between the screw head 14 and the assembly hole 53, the protective cap 50 is fixed on the screw head and prevents the screw head from rotating in the assembly hole 53. The protective cap is designed with at least one arm 51 which, when the protective cap 50 is pressed onto the screw head 14 of the conical screw 10, is placed between the first thread half 20 and the second thread half 30. The arms 51, 52 of the protective cap are designed in terms of their size in order to fit between the first thread half 20 and the second thread half 30. The arms 51, 52 of the protective cap lock the protective cap 50 in a position mounted on the screw head 14 of the conical screw 10, and the protective cap 50 prevents earth or other dirt from getting into the space around the screw head 14. The arms 51, 52 of the protective cap 50 lock the position of the conical screw 10 in the lock 2 with friction, and the thread of the screw 10 is also designed to prevent the conical screw 10 from coming loose.

FIG. 7 shows the lock 2 with a conical screw 10, a first thread half 20, a second thread half 30, a protective cap 50 and a retainer device 60. By means of a retainer device 60 being mounted in the retainer device recess 24, 34, the first thread half 20 is held against the second thread half 30, thus retaining the conical screw 10 between the thread halves. In this way, the lock 2, with all the components thereof, can be held together in one unit, for example for supply. The retainer device 60 is made, for example, of spring steel or rubber, although other metals or elastomers are also conceivable.

When an excavating tooth 3 is mounted on a wearing-part holder 4, a lock opening 6 is defined, or arises, in which the lock 2 is mounted. The lock 2 is mounted in the lock opening 6 by means of the first thread half 20 being placed in the lock opening 6 and the lower recess 25 of the first thread half facing a heel 40 formed on the excavating tooth 3. Moreover, the first thread half 20 has an upper lateral arm 28 which retains the first thread half 20 in a cavity 43 formed for the upper lateral arm 28, preferably in the wearing-part holder 4, although it can also be formed in the excavating tooth 3, or in the excavating tooth 3 and wearing-part holder 4 in combination. The first thread half 20 can also be formed in another way in order to retain the thread half in the lock opening, for example with a T-shaped appearance. After the first thread half 20 has been fitted, the second thread half 30 can be placed and mounted in the opening 6 by means of the lower recess 35 of the second thread half being placed against the lower heel 27 of the first thread half. Moreover, the second thread half 30 also has an upper lateral arm 38 which retains the second thread half 30 in a cavity 43 formed for the upper lateral arm 38, preferably in the wearing-part holder 4, although it can also be formed in the excavating tooth 3, or in the excavating tooth 3 and wearing-part holder 4 in combination. The second thread half 30 can be designed in another way in order to retain the thread half in the lock opening 6, for example with a T-shaped appearance. The upper lateral arm 28 of the first thread half 20 is preferably placed such that it faces the upper lateral arm 38 of the second thread half 30 when the first thread half 20 is placed against the second thread half 30 in the lock opening 6. Moreover, the second thread half 30 has an upper rear arm 36 which is placed against the upper pin 41 of the excavating tooth 3 and in a cavity 42 formed in the wearing-part holder 4. After the two thread halves, also called the two clamps, the first thread half 20 and the second thread half 30, have been mounted in the lock opening 6, the conical screw 10 can be mounted in the opening which arises between the two thread halves. When the second thread half 30 has been fitted against the first thread half 20, the recess 21 comes to face the recess 31, and an opening arises in which the conical screw 10 can be placed. When the conical screw 10 has been placed in the opening between recess 21 and recess 31, the tip 15 of the conical screw comes to be placed between the first thread bed 23 and the second thread bed 33, whereupon the thread 11 of the conical screw comes into contact with the first thread bed 23 and the second thread bed 33. When the conical screw 10 is screwed down into the thread bed, the conical screw 10 comes to move in the axial direction of the conical screw and widens the distance between the first thread half 20 and the second thread half 30, whereupon the first thread half 20 moves, substantially in a sideways movement, in the direction of the excavating tooth 3, and the second thread half 30 moves, substantially in a sideways movement, towards the wearing-part holder 4. The sideways movement is radially outwards from the screw, at right angles to the axial direction of the screw. When the thread bed 23 of the first thread half 20 and the thread bed 33 of the second thread half 30 are inclined and when the conical screw 10 is conical, this results in a sideways movement, radially from the screw, on the first thread half 20 and on the second thread half 30 when the conical screw 10 moves axially between the first thread half 20 and the second thread half 30. As the conical screw 10 is rotated, preferably clockwise, the two thread halves 20, 30 come to fix the excavating tooth 3 against the wearing-part holder 4 and to lock the whole wearing-part system 1. When the first thread half 20 moves towards the excavating tooth 3, the flexible ridge 26 is compressed and gives increased resistance when the conical screw 10 is rotated. By means of the flexible ridge 26 being compressed, a static force is applied to the first thread half 20 and therefore to the lock 2, which force retains the conical screw 10 and therefore the lock 2 in the locked state. When the conical screw 10 is tightened with a predetermined torque, or to a predetermined position, the rotation of the conical screw 10 is ended, and the conical screw 10 can be protected and/or fixed by, for example, a protective cap 50 or a rubber hood or other protective device for the screw head 14. The protective cap 50 is made of rubber or another elastomer such that, on the one hand, it can be mounted elastically on the screw head 14 and, on the other hand, can provide considerable friction against the screw head 14. The protective cap is designed with a hole 53 in which the screw head 14 is pressed. The hole 53 formed in the protective cap 50 can be circular, but it can also have other configurations, for example twelve-sided, or other shapes for achieving contact with the screw head 14 with high friction between the screw head 14 and the protective cap 50. The protective cap is designed with at least one arm, preferably two arms 51, 52 which, when the protective cap has been placed on the screw head 14, lock the screw head 14 in the assembly hole 53 and lock the protective cap 50 between the first thread half 20 and the second thread half 30. In order to retain the conical screw 10 in the lock 2, the threads 11 can be designed to statically lock the conical screw 10 in the lock 2. In addition to the configuration of the threads, an elastomer or other resilient or flexible device can be used between the tip 15 of the screw and the bottom of the thread halves. The elastomer can also be provided in the thread 23 of the first thread half 20 and the thread 32 of the second thread half 30 or can be mounted in the form of a rubber block or other device separately in the space which arises when the first thread half 20 is placed against the second thread half 30. Moreover, the elastomer can also be designed on the tip 15 of the screw 10. When the conical screw 10 is screwed into the lock 2, the elastomer is compressed and applies a locking force to the conical screw 10. The conical screw 10 is screwed using suitable equipment, for example a hydraulic or pneumatic nut tightener, to a predefined torque. Where no pneumatic or hydraulic nut tightener is present, a suitable ratchet handle or other equipment can also be used to tighten the conical screw 10 to a suitable torque. The conical screw 10, the thread halves 20, 30, the excavating tooth 3 or the wearing-part holder 4 can also be designed with visual markings showing the position to which the conical screw 10 is to be tightened. Upon assembly of the lock 2, when a retainer device 60 is used, the first thread half 20 and the second thread half 30, held together by the retainer device 60, are placed together in the assembly recess 6. In those cases where the lower heel 27 of the first thread half is large and placed against the lower recess 35 of the second thread half, the lock 2 can be easily assembled when the first thread half 20 and the second thread half 30 are mounted in combination. By adapting the size of the lower heel 27 of the first thread half, assembly and disassembly of the first thread half 20 and the second thread half 30 can be carried out separately. Preferably, the first thread half 20 and the second thread half 30 are assembled and disassembled in a state held together by a retainer device 60. When the first thread half 20 and the second thread half 30 are placed in the assembly opening 6, the conical screw 10 is placed in the opening between recess 21 and recess 31 and is screwed between the first thread bed 23 and the second thread bed 33 and in this way locks the lock 2.

When the excavating tooth 3 is worn and needs to be replaced, the protective cap 50 is removed from the screw head 14 on the conical screw 10. Thereafter, the conical screw 10 is rotated, preferably counterclockwise, in order to release the lock 2. When the conical screw 10 is unscrewed and removed from the lock opening 6, the second thread half 30 can be lifted out of the lock opening 6, and the first thread half 20 can thereafter be lifted out of the lock opening 6. The excavating tooth 3 can thereafter be removed from the wearing-part holder 4. Upon disassembly of the lock 2, when a retainer device 60 is used, the first thread half 20 and the second thread half 30, held together by the retainer device 60, are removed together from the assembly recess 6.

An example of the design of the wearing part system consists of a lock 2, or lock system, comprising a first thread half 20, a second thread half 30 and a conical screw 10. The lock 2 is mounted between an excavating tooth 3 and the wearing-part holder 4 and locks the excavating tooth 3 to the wearing-part holder 4. Each apparatus, for example a bucket, has a plurality of wearing-part systems 1 mounted on the apparatus. The wearing-part holders 4 are welded onto the bucket and can be dismantled from the bucket if the wearing-part holder 4 needs to be replaced. The wearing-part system 1, and thus the lock system 2, is adapted to all sizes of wearing parts 3 and to all types of applications of excavating teeth, wearing-part systems and tools. The excavating teeth can be continuously replaced by the operator of the machinery in a reliable manner compared to earlier methods where wedges were hammered into place. The conical screw 10 can be replaced by a conical wedge (not shown in the figure) which is hammered or pressed down between the first thread half 20 and the second thread half 30. The conical wedge is preferably made of a hard elastomer, although other materials can be used, such as copper or another metal.

The invention claimed is:

1. A lock for releasable locking of an excavating tooth to a wearing-part holder in a wearing-part system, where the excavating tooth and the wearing-part holder together define a lock opening for receiving the lock, where the lock comprises a threaded conical screw and a first thread half designed with a first thread bed and having an upper lateral arm, wherein the first thread half and a second thread half, designed with a second thread bed and having an upper rear arm and an upper lateral arm, are for mounting in the lock opening, where the first thread half and the second thread half, with the thread beds directed towards each other, together define an opening for threaded fastening of the threaded conical screw, such that rotation of the threaded screw is for moving the threaded screw along the thread beds-in the axial direction of the screw into the lock opening, locking the lock when the first thread half is moved towards the excavating tooth and the second thread half is moved towards the wearing-part holder; and wherein the first thread half and the second thread half are provided with a lower heel and a lower recess, respectively for facilitating the positioning of the first thread half and the second thread half into the lock opening.

2. The lock according to claim 1, wherein a protective cap, designed with an assembly hole, is placed on the screw head of the conical screw and retains the conical screw-in the screwed-in position due to the wings locking the protective cap and thus the screw between the first thread half and the second thread half.

3. A wearing-part system comprising a wearing-part holder, an excavating tooth, a lock arrangement, where the lock arrangement comprises a first thread half designed with a first thread bed and having an upper lateral arm and a conical screw for locking the excavating tooth to the wearing-part holder, wherein the lock arrangement comprises the first thread half, the conical screw and a second thread half designed with a second thread bed and having an upper rear arm and an upper lateral arm, wherein the first thread half is mounted in a lock opening with the first thread bed directed towards the wearing-part holder, and the second thread half is mounted in the lock opening with the second thread bed directed towards the excavating tooth, wherein the thread beds together define an opening in which the conical screw can rotate and move along the thread beds in the axial direction of the screw, such that the first thread half is moved towards the excavating tooth and the second thread half is moved towards the wearing-part holder, locking the excavating tooth to the wearing-part holder; and wherein the first thread half and the second thread half are provided with a lower heel and a lower recess, respectively for facilitating the positioning of the first thread half and the second thread half into the lock opening.

4. A method for releasable locking of an excavating tooth to a wearing-part holder in a wearing-part system with a lock comprising a threaded conical screw and a first thread half with a thread bed, wherein:

a) the excavating tooth is mounted against the wearing-part holder;

b) the first thread half, designed with the first thread bed and having an upper lateral arm, and a second thread half, designed with a second thread bed and having an upper rear arm and an upper lateral arm, are mounted facing each other in an assembly opening formed in the excavating tooth together with the wearing-part holder, where c) the threaded conical screw is mounted in an opening between the first thread half and the second thread half, and wherein the first thread half and the second thread half are provided with a lower heel and a lower recess, respectively for facilitating the positioning of the first thread half and the second thread half into the opening, where d) the lock is expanded and locks the wearing part to the holder when, during the screwing-in of the threaded conical screw, the axial movement of the threaded conical screw moves the first thread half and the second thread half at right angles out from the axial direction of the conical screw, and e) the lock is contracted and releases the wearing part from the holder when, during the unscrewing of the threaded conical screw, the axial movement of the threaded conical screw moves the first thread half and the second thread half at right angles in towards the axial direction of the conical screw.

* * * * *